United States Patent [19]

Heiman et al.

[11] 3,961,921

[45] June 8, 1976

[54] VACUUM CLEANER WITH AN IMPERMEABLE COLLECTOR BAG

[75] Inventors: Richard I. Heiman; David R. Hult, both of Columbus, Ind.

[73] Assignee: Vernco Corporation, Columbus, Ind.

[22] Filed: Oct. 15, 1974

[21] Appl. No.: 514,587

[52] U.S. Cl. ..... 55/429; 55/364; 55/373; 55/378; 55/381; 55/DIG. 2

[51] Int. Cl.[2] ..... B01D 45/18

[58] Field of Search ..... 55/364, 366, 373, 378, 55/500, 381, 502, DIG. 2, DIG. 3, 429, 309, 310

[56] References Cited

UNITED STATES PATENTS

| | | | |
|---|---|---|---|
| 948,993 | 2/1910 | Hemmer | 55/373 X |
| 1,828,584 | 10/1931 | Anderson | 55/364 X |
| 1,879,667 | 9/1932 | Farmer et al. | 55/364 X |
| 1,881,086 | 10/1932 | Marshall | 55/364 X |
| 1,924,249 | 8/1933 | Marshall | 55/364 |
| 2,025,946 | 12/1935 | Wenner-Gren | 55/429 X |
| 2,027,590 | 1/1936 | Hirsch | 55/364 X |
| 2,222,077 | 11/1940 | Kahn | 55/366 |
| 2,697,512 | 12/1954 | Brown | 55/364 X |
| 2,714,426 | 8/1955 | White | 55/366 X |
| 2,815,621 | 12/1957 | Carter | 55/429 X |
| 3,653,190 | 4/1972 | Lee et al. | 55/366 X |

FOREIGN PATENTS OR APPLICATIONS

| | | | |
|---|---|---|---|
| 55,055 | 7/1943 | Netherlands | 55/364 |
| 1,201,841 | 8/1970 | United Kingdom | 55/378 |
| 766,086 | 1/1957 | United Kingdom | 55/364 |

*Primary Examiner*—Frank W. Lutter
*Assistant Examiner*—David L. Lacey
*Attorney, Agent, or Firm*—Jenkins, Hanley & Coffey

[57] ABSTRACT

A vacuum cleaner including a tank having an interior space for receiving dirt and debris, the tank providing an access opening, a blower assembly including a housing for closing the access opening, the housing providing, within the boundary of the access opening, an intake port for the tank, and the blower assembly including a motor and a blower for drawing air from the tank to create a vacuum therein. An impermeable flexible bag is disposed in the tank to provide a lining, the bag having a mouth in registry with the access opening such that dirt and debris entering the intake port are deposited into the bag. The bag has at least one vent opening therein for establishing venting between the interior of the bag and the space between its exterior and the internal surfaces of the tank to equalize the air pressure within the bag and the tank or the bag is disposed in the tank in such a manner as to establish such venting and equalize the air pressure.

13 Claims, 10 Drawing Figures

VACUUM CLEANER WITH AN IMPERMEABLE COLLECTOR BAG

The present invention relates to vacuum cleaners and more particularly to the provision of the type of vacuum cleaner used in shops and other such areas. Such vacuum cleaners have tanks providing an interior space for receiving dirt and debris such as sawdust. The tank provides an access opening, and the conventional blower assembly includes a housing for closing the access opening and for providing an intake port for the tank. In such conventional vacuum cleaners, the blower assembly creates a vacuum within the tank to pull dirt and debris into the tank through the intake port. The dirt and debris are deposited into the well of the tank. The dirt and debris are removed from the tank by removing the blower assembly and dumping the tank into trash containers and the like.

The present invention involves placing an impermeable bag in the tank as a liner such that the tank can be cleaned simply by removing the bag, closing its mouth and depositing the used bag in a trash can.

Note that the invention involves placing an impermeable bag within the collection tank to serve as a liner for the tank. The mouth of the bag is in registry with the access opening of the tank and, in fact, the mouth of the bag may preferably be held securely engaged about the periphery of the access opening or about an internal rim in registry with and adjacent the access opening. The invention herein involves venting the bag or means for venting the bag so that it will not be sucked upwardly into the blower assembly or against the blower assembly Particularly, the bag is provided with at least one vent opening spaced inwardly from its mouth portion and establishing venting between the interior of the bag and the space between its exterior and the internal surfaces of the tank to equalize the air pressure within the bag and the tank. Alternatively, the internal rim about which the mouth is engaged may be apertured to provide such venting.

An object of the present invention, therefore, is to provide such a vacuum cleaner comprising an impermeable flexible bag means disposed in and lining the tank, the bag means having a mouth in registry with the access opening of the tank such that dirt and debris entering the intake port of the cleaner are deposited into the bag means, and the bag means also having means for establishing venting between its interior and the space between its exterior and the internal surfaces of the tank to equalize the air pressure within the bag means and the tank.

Vacuum cleaners which comprise air permeable bags are, of course, well known. Such vacuum cleaners draw air and dirt and debris into the bags which inflate and through the walls of which the air escapes leaving the dirt and debris.

Another object of the present invention is to provide such a cleaner in which the bag means includes an impermeable flexible bag disposed in and lining the tank, the bag having at least one vent opening therein for establishing venting between the interior of the bag and the space between its exterior and the internal surfaces of the tank to equalize the air pressure within the bag and the tank.

Still another object of the present invention is to provide such a cleaner in which the bag means includes an impermeable bag and a relatively stiff ring disposed in the bag adjacent its mouth, the bag having its mouth folded over the ring such that the ring defines the opening into the bag means. The ring is held in registry with the access opening of the tank, and the ring is preferably provided with peripherally spaced apart, outwardly extending projections engaging the internal surfaces of the tank such that the spaces between the projections establish the venting required.

Yet another object of the present invention is to provide such a cleaner with a fixed or removable retainer ring inside the tank, adjacent to the access opening and in registry with the access opening, the mouth portion of the bag being engaged with the ring, and the ring being apertured to provide venting between the interior of the bag and the space between the exterior of the bag and the interior of the tank.

Other objects and features of the present invention will become apparent as this description progresses. To the accomplishment of the above and related objects, this invention may be embodied in the forms illustrated in the accompanying drawings, attention being called to the fact, however, that the drawings are illustrative only, and that changes may be made in the specific constructions illustrated and described, so long as the scope of the appended claims is not violated.

In the drawings

Figures 1, 2, 3, 4:
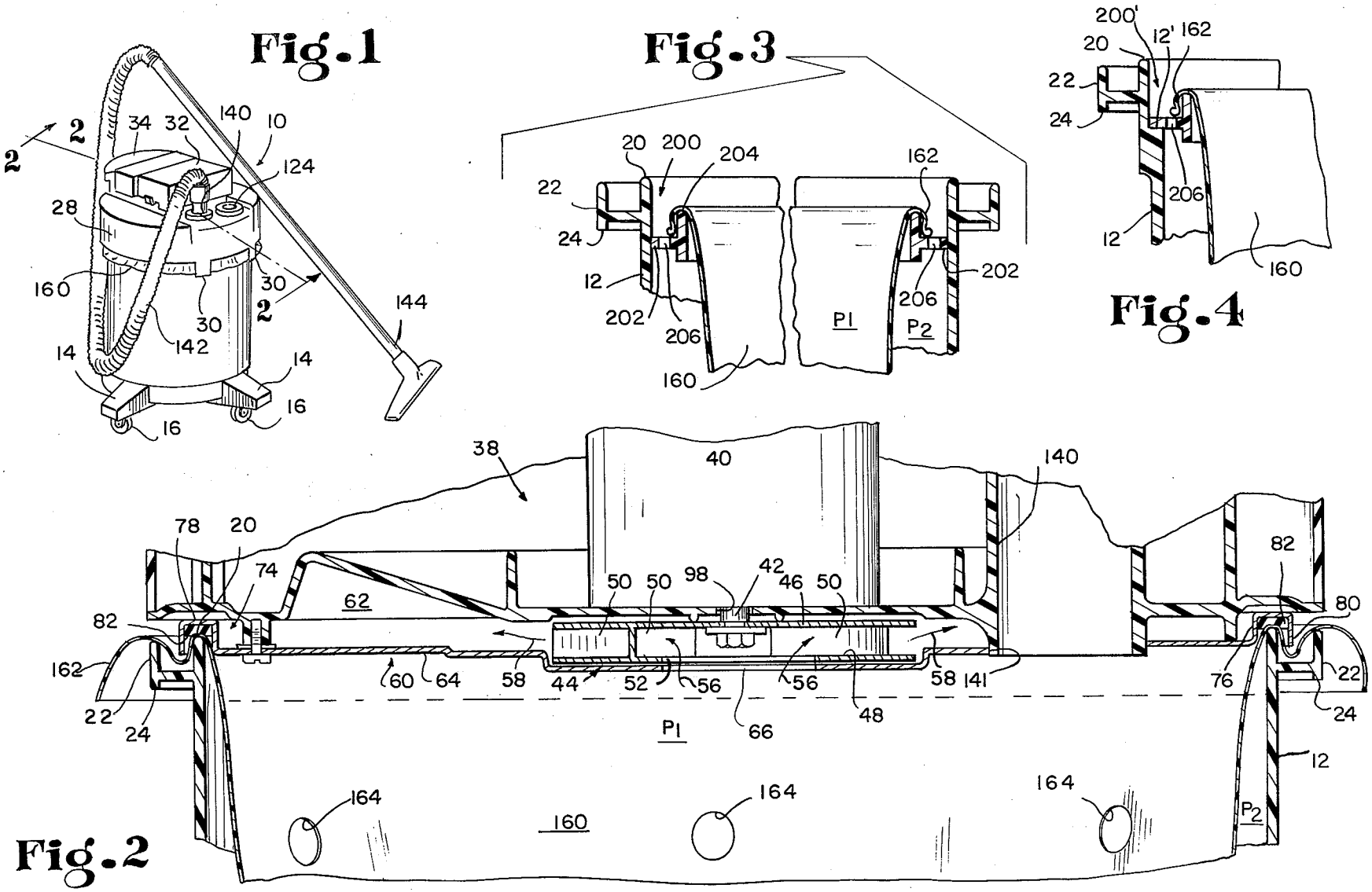
FIG. 1 is a perspective view of a vacuum cleaner in accordance with the present invention.
FIG. 2 is a fragmentary and enlarged sectional view taken generally along the line 2—2 in FIG. 1.
FIG. 3 is a fragmentary sectional view of one embodiment of the present invention showing the retainer ring concept.
FIG. 4 is another fragmentary sectional view showing still another retainer ring embodiment.

Referring now particularly to the drawings, it will be seen that there is illustrated a vacuum cleaner 10 of the upright tank-type comprising a tank 12 supported on feet 14 and casters 16. The tank 12 may be a generally cylindrical tank, the upper end of which is open to provide a peripherally extending upper edge 20 or access opening 20 lying in a generally horizontal plane. In the illustrative and preferred embodiment, the upper edge portion of the tank 12 is also provided with a peripherally and outwardly extending channel section or trough section 22 which is formed to provide a peripherally and downwardly extending edge portion 24 used in fastening the vacuum cleaner together. Particularly, the illustrative cleaner 10 includes a housing cover or shroud 28 which preferably is plastic and which is formed with depending clips 30 which engage the edge portion 24.

Then, a hood 32 having a portion 34 on which the electrical service cord may be wrapped is mounted upon the cover 28. Beneath the cover 28 is a blower assembly 38 comprising a motor 40 having a downwardly extending output shaft 42 upon which a blower wheel 44 is mounted, the blower wheel including an upper disc 46, a lower disc 48 and blades 50 extending between the two discs. The lower disc 48 provides a concentric inlet opening 52. The blower wheel 44 is a backwardly curved centrifugal blower wheel with the center opening 52 such that, when the wheel is driven, air is drawn into the concentric opening as indicated by the arrows 56 and expelled radially outwardly from the space between the discs 46, 48 as indicated by the arrows 58.

The blower assembly 38 includes a blower housing 60 providing an interior space 62 in which the blower wheel 44 is disposed. The housing includes a lower, circular wall 64 having a concentric opening 66 therein which is in registry with and of the same general size as the opening 52 in the bottom disc 48 of the blower wheel 44. The outer peripheral edge portion of the lower wall 64 is formed to include a raised portion 74, the radial cross section of which includes an upwardly extending wall section 76, a horizontally outwardly extending wall section 78 and a downwardly extending wall section 80. The raised portion 74, therefore, provides a channel section receiving a gasket 82 which engages and seals against the opening 20 of the tank 12.

The blower assembly 38 provides a discharge port 124 through which at least part of the air expelled radially outwardly by the blower 44 is exhausted. The assembly also includes a ferrule 140 which is in registry with an opening 141 in the lower wall 64 to provide an intake port for the tank 12. Particularly, a hose 142 is placed in the ferrule 140 when the vacuum cleaner 10 is used to pick up dirt and debris, the illustrative hose 142 including a conventional fitting as indicated at 144. When it is desired to use the vacuum cleaner 10 for blowing purposes, the hose is connected to the discharge port 124.

The vacuum cleaner 10 described thus far is similar in structure to the vacuum cleaner disclosed in the commonly assigned and co-pending U.S. Pat. application Ser. No. 418,560 filed Nov. 23, 1973, now U.S. Pat. No. 3,906,584. Operation of the vacuum cleaner 10 will deposit dirt, debris and objects into the tank 12 through the intake port 140. In accordance with the present invention, impermeable flexible bag means is disposed in the tank 12 to provide a liner for the tank. In this description and in the claims appended hereto, the term "impermeable" means that the bag material will not pass air therethrough, at least not in any significant amount. In other words, the impermeable bag means or impermeable bag of the present invention is formed from a material through which air will not flow. This is contrary to the concept of many bag-type vacuum cleaners having bags with air permeable walls.

In the illustrative embodiment of FIG. 2, an impermeable bag 160 is placed in the tank 12 to be a liner for that tank, the bag having a mouth portion 162 which is suspended over the access opening 20 to be engaged by the gasket 82. At least one and maybe two or three or more small diameter vent openings 164 are provided in the bag adjacent the mouth portion to provide the necessary venting between the space inside the bag and the space between the interior wall and floor of the tank 12 and the exterior wall of the bag. The openings 164, therefore, equalize the air pressure within the bag and the tank. Without such venting, of course, operation of the motor 40 and blower wheel 44 would exhaust the air from the interior of the bag such that the bag would be drawn upwardly or forced upwardly into the blower wheel or at least against the opening 66. Assume that the pressure within the bag is designated by $P_1$ and the pressure in the space between the exterior of the bag and the interior of the tank is designated by $P_2$. When the motor 40 is not running, $P_1 = P_2$. That is the "at rest" condition. As the vacuum is drawn, $P_1$ decreases and initially $P_2$ remains constant such that the volume $V_1$ of the bag starts to decrease while the volume $V_2$ of the space between the exterior of the bag and the interior of the tank starts to increase. The small diameter holes 164 decrease the rate at which $V_1$ and $V_2$ change. After a small time period, $P_2 = P_1$.

Figure 7:
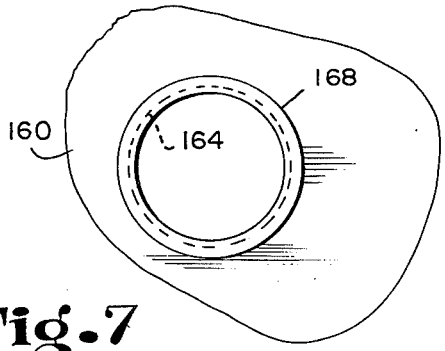
FIG. 7 is a fragmentary view of a portion of a bag showing an eyelet bounding a vent opening.
Figure 8:
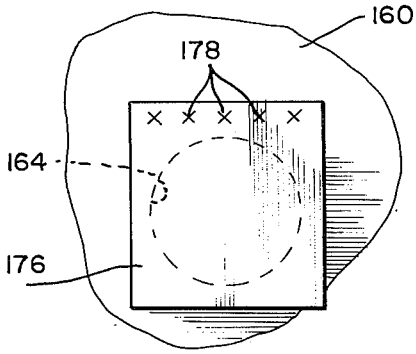
FIG. 8 is a fragmentary view showing a portion of a bag with a valve flap secured to the interior surface of the bag to cover the vent opening in the wall of the bag.
Figure 10:
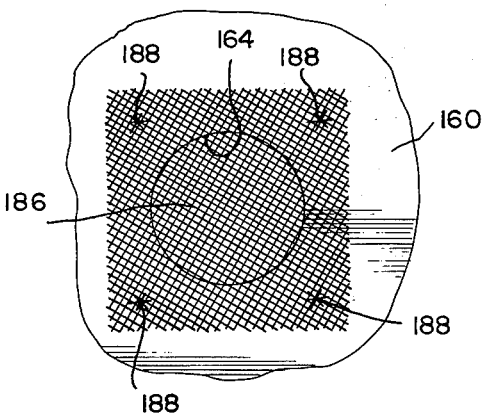
FIG. 10 is a fragmentary view of a portion of the bag showing the vent opening covered by a mesh material.
Figure 9:
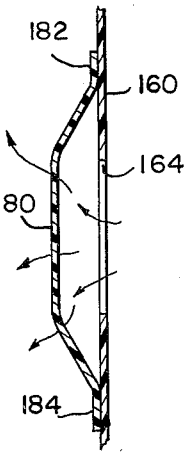
FIG. 9 is a fragmentary sectional view showing a slightly different type of flap valve.

In FIG. 7, we show an opening 164 with an eyelet 168 bounding the opening. The eyelet may be a plastic or metal eyelet which is conventionally attached to the bag to strengthen the edge of the opening 164 to prevent tearing of the bag. In FIG. 8, we show the interior of the bag 160 with the opening 164 covered by a flap 176 which may be a flexible plastic flap attached to the wall of the bag by heat sealing techniques or adhesive techniques as indicated at 178. The flap 176 serves as a sort of a valve permitting air to move into the bag, but preventing dust and debris from exiting the bag through the opening 164. In FIG. 9, we show a segment of the bag 160 with the opening 164 therein and with a flexible plastic cover 180 over the opening on the interior surface of the bag. The cover 180 is fastened to the wall of the bag 160 as indicated at 182, 184 above and below the opening so that the cover will bulge inwardly to provide a tunnel of sorts with open ends and which is in communication with the opening 164. Thus, air can enter the bag through the opening 164 and about the cover 180 while the cover serves to keep dust and debris from leaving the bag through the opening. Finally, in FIG. 10, we show a segment of the bag 160 with the opening 164 therein and with a mesh cover 186 or air permeable cloth of some sort covering the opening 164. The permeable material may be attached to the bag by adhesive techniques or heat sealing techniques as indicated at 188. The mesh material will permit air to enter the bag but tend to keep sawdust and debris and dirt from exiting the bag through the opening 164. While we show the embodiments of FIGS. 7–10, we must point out that we have been quite satisfied with bags with one or two small diameter vent openings 164 adjacent the mouth portion 162 of the bag 160. We have found that only an insignificant amount of dust and debris will leak out through such openings during the process of removing and disposing of the bag.

In the embodiment of FIG. 3, a retainer ring 200 extends about the interior of tank 12 adjacent the access opening 20. The ring 200 may be adhesively or otherwise permanently secured to the tank at 202. The illustrative ring provides, at its radially inner edge portion, a flange 204 extending peripherally about the tank and outwardly toward the opening 20. The mouth portion 162 the bag is engaged with this flange 204 as illustrated. For instance, the mouth of the bag may be provided with a draw string or an elastic means of some sort or an adhesive means which engages the radially outer portion of the flange 204. The advantage of the FIG. 3 structure, of course, is that the mouth portion of the bag does not need to extend outside the tank 12. Then, in order to provide the venting required to keep the bag from being pulled upwardly into the blower assembly, the ring 200 itself may be provided with one or more apertures indicated at 206.

The FIG. 4 structure is similar to the FIG. 3 structure except that the ring 200' may be a removable ring which rests, for instance, on a peripherally extending ledge 12' provided by the tank adjacent the access opening 20.

Figure 5:
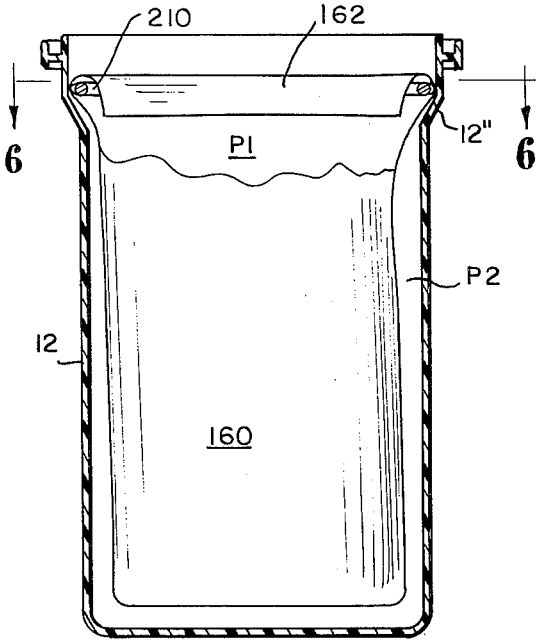
FIG. 5 is a sectional view of a tank with an impermeable bag therein with a stiff ring in the mouth portion of the bag to define the opening of the bag.
Figure 6:
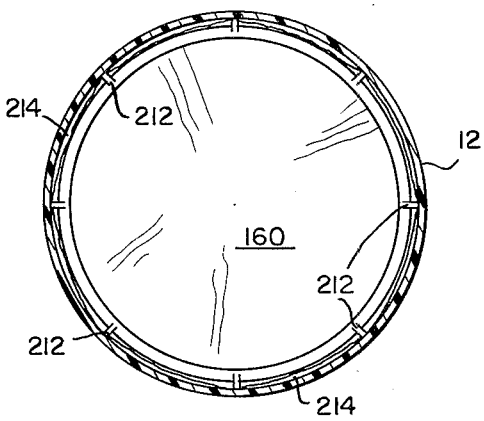
FIG. 6 is a sectional view taken generally along the lines 6—6 in FIG. 5.

Finally, in the embodiment of FIGS. 5 and 6, the mouth portion 162 of the bag 160 is turned inwardly and downwardly over a relatively stiff ring 210. The ring 210 may be provided with radially outwardly extending protrusions 212 which engage, for instance, a reduced peripherally extending portion 12'' of the tank 12. The portions of the bag in between the protrusions 212 will deflect inwardly to provide a vent space 214 at a plurality of places about the mouth portion of the bag 160.

Thus, in the embodiments of FIGS. 3–6, the necessary venting is provided by the illustrative retaining ring structures while in the embodiments of FIGS. 2 and 7–10, the necessary venting is provided by the openings 164.

We claim:

1. A vacuum cleaner including a tank having an interior space for receiving dirt and debris, said tank providing an access opening, a blower assembly including a housing for closing said access opening, said housing providing, within the boundary of said access opening, an intake port for said tank, and said blower assembly including a motor and a blower for drawing air from said tank to create a vacuum therein, and in which the improvement comprises impermeable flexible bag means disposed in and lining said tank, said bag means having a mouth in registry with said access opening such that dirt and debris entering said intake port are deposited into the interior of said bag means, and said bag means also having means for establishing venting between its interior and the space between its exterior and the internal surfaces of said tank to equalize the air pressure within said bag means and tank.

2. The improvement of claim 1 in which said bag means includes an impermeable bag and a relatively stiff ring disposed in said bag adjacent its mouth, said bag having its mouth portion folded over said ring such that said ring defines the opening into said bag means, said ring being in registry with said access opening, said ring being provided with peripherally spaced apart, outwardly extending projections engaging the internal surfaces of said tank such that the spaces between said projections establish said venting.

3. The improvement of claim 1 including a retaining ring in said tank adjacent to and in registry with said access opening, said bag means including an impermeable bag having its mouth portion engaged with said ring, said ring being apertured to provide such venting.

4. The improvement of claim 3 in which said access opening and said retaining ring are circular, said ring having radially outer and radially inner peripheral edge portions, said ring providing, at its radially inner edge portion, flange means extending peripherally and toward said access opening, said bag mouth portion being engaged with said flange means.

5. A vacuum cleaner including a tank having an interior space for receiving dirt and debris, said tank providing an access opening, a blower assembly including a housing for closing said access opening, said housing providing, within the boundary of said access opening, an intake port for said tank, and said blower assembly including a motor and a blower for drawing air from said tank to create a vacuum therein, and in which the improvement comprises an impermeable flexible bag disposed in and lining said tank, said bag having a mouth in registry with said access opening such that dirt and debris entering said intake port are deposited into said bag, and said bag having at least one vent opening therein for establishing venting between the interior of the bag and the space between its exterior and the internal surfaces of said tank to equalize the air pressure within said bag and tank.

6. The improvement of claim 2 in which said bag is provided with a mouth portion bounding its said mouth, said mouth portion being folded outwardly and over the edge of said access opening to be clamped over said edge by said housing, and said vent opening being spaced inwardly from said mouth portion to be disposed within said tank.

7. The improvement of claim 6 including flap means attached to the interior of said bag and arranged to overlie said vent opening, said flap means being effective to keep dirt and debris from leaving said bag through said vent opening and to permit air movement for said space between the exterior of said bag and the interior of said tank into the interior of said bag.

8. The improvement of claim 6 including one-way valve means attached to said bag to prevent dirt and debris from leaving said bag through said vent opening and to permit air movement from said space between the exterior of said bag and the interior of said tank into the interior of said bag.

9. The improvement of claim 6 in which said vent opening is defined by an aperture in the wall of said bag with an eyelet bounding said aperture.

10. The improvement of claim 5 including flap means attached to the interior of said bag and arranged to overlie said vent opening, said flap means being effective to keep dirt and debris from leaving said bag through said vent opening and to permit air movement from said space between the exterior of said bag and the interior of said tank into the interior of said bag.

11. The improvement of claim 5 including one-way valve means attached to said bag to prevent dirt and debris from leaving said bag through said vent opening and to permit air movement from said space between the exterior of said bag and the interior of said tank into the interior of said bag.

12. The improvement of claim 5 in which said vent opening is defined by an opening formed in said bag and an eyelet bounding said opening.

13. The improvement of claim 5 in which said vent opening is covered by an air permeable material effective to prevent dirt and debris from moving through said opening.

* * * * *

UNITED STATES PATENT OFFICE

CERTIFICATE OF CORRECTION

Patent No. 3,961,921 Dated June 8, 1976

Inventor(s) Richard I. Heiman and David R. Hult

It is certified that error appears in the above-identified patent and that said Letters Patent are hereby corrected as shown below:

Column 4, line 60, after "162" insert -- of --.
Column 5, line 2, after "apertures" insert -- as --.
Column 6, line 18 (Claim 6, line 1) "claim 2" should be -- claim 5 --.
Column 6, line 30, (Claim 7, line 6) "for" should be -- from --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*